US005322274A

United States Patent [19]

Takahashi et al.

[11] Patent Number: 5,322,274

[45] Date of Patent: Jun. 21, 1994

[54] SHEET CONVEYING APPARATUS

[75] Inventors: Yuji Takahashi, Tokyo; Masakazu Hiroi, Yokohama, both of Japan

[73] Assignee: Canon Kabushiki Kaisha, Tokyo, Japan

[21] Appl. No.: 65,022

[22] Filed: May 24, 1993

Related U.S. Application Data

[63] Continuation of Ser. No. 814,060, Dec. 26, 1991, abandoned, which is a continuation of Ser. No. 522,100, May 11, 1990, abandoned.

[30] Foreign Application Priority Data

May 12, 1989 [JP] Japan ..... 1-117457
May 12, 1989 [JP] Japan ..... 1-117458

[51] Int. Cl.[5] ..... B65H 7/02
[52] U.S. Cl. ..... 271/258; 271/256
[58] Field of Search ..... 271/256, 257, 258, 261, 271/302, 303, 304, 298

[56] References Cited

U.S. PATENT DOCUMENTS 4,231,567 11/1980 Ziehm ..... 271/259
4,474,454 10/1984 Sugiura ..... 355/14 R
4,878,087 10/1989 Sakai et al. ..... 271/258 X
4,973,041 11/1990 Yamasaki ..... 271/298

FOREIGN PATENT DOCUMENTS 60-214374 10/1985 Japan .
61-231568 10/1986 Japan .
63-176246 7/1988 Japan .
122856 5/1989 Japan .

OTHER PUBLICATIONS

IBM Technical Disclosure Bulletin, R. C. Brannnan, et al., "Saving Copies After Misfeed", Dec. 1980, vol. 23, No. 7A, p. 2694 3 pp. European Search Report.

*Primary Examiner*—Robert P. Olszewski
*Assistant Examiner*—Carol L. Druzbick
*Attorney, Agent, or Firm*—Fitzpatrick, Cella, Harper & Scinto

[57] ABSTRACT

In a sheet conveying apparatus having a jam detecting means, there are provided an accommodating portion for jam treatment and a conveyance controlling means to accommodate sheets on a conveyance path into said portion, enabling all the sheets on the path to be gathered in one place and rendering the removal treatment easier. In another aspect of this invention, in case of jam occurrence, the sheets being conveyed are temporarily accommodated in the standby accommodating portion for discharge and then rejected outside the apparatus after jam return, while an image forming portion carrying out the image formation onto the sheets to be accommodated so that they can be discharged as regular output sheets, and image formation being prohibited when the sheets are discharged, resulting in that the image previously formed on the sheets is not to be disturbed.

12 Claims, 9 Drawing Sheets

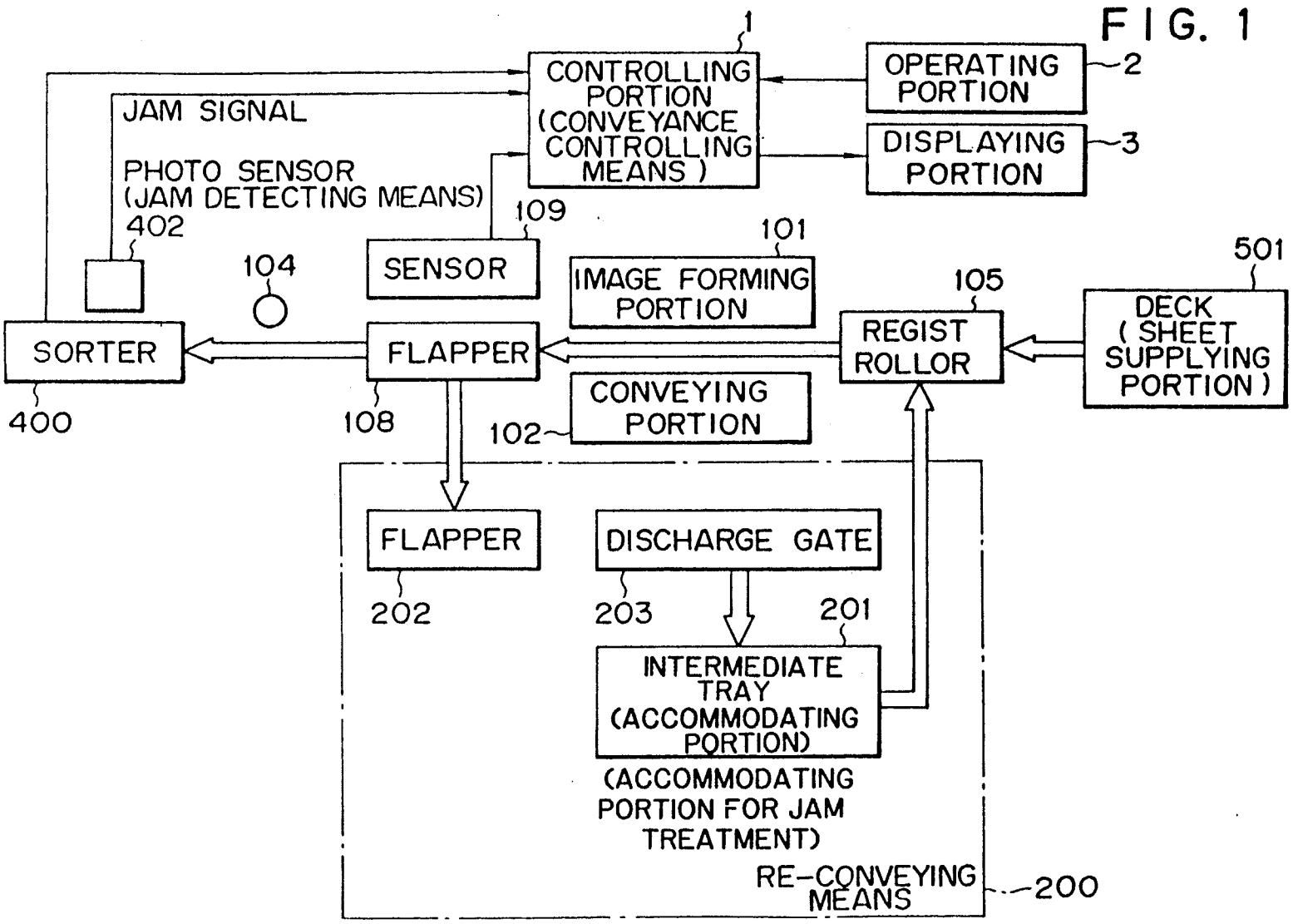
FIG. 1
OPERATING PORTION
2
DISPLAYING PORTION
3
CONTROLLING PORTION (CONVEYANCE CONTROLLING MEANS)
1
DECK (SHEET SUPPLYING PORTION)
501
REGIST ROLLOR
105
IMAGE FORMING PORTION
101
CONVEYING PORTION
102
SENSOR
109
FLAPPER
108
JAM SIGNAL
PHOTO SENSOR (JAM DETECTING MEANS)
402
104
SORTER
400
DISCHARGE GATE
203
FLAPPER
202
INTERMEDIATE TRAY (ACCOMMODATING PORTION)
201
(ACCOMMODATING PORTION FOR JAM TREATMENT)
RE-CONVEYING MEANS
200

SHEET CONVEYING APPARATUS

This application is a continuation of application Ser. No. 07/814,060 filed Dec. 26, 1991, now abandoned, which was a continuation of application of Ser. No. 07/522,100, filed May 11, 1990, abandoned.

BACKGROUND OF THE INVENTION

1. Field of the Invention

The present invention relates to a sheet conveying apparatus for an electrophotographic copying machine, a printing press, a printer, an automatic document feeder (ADF) or the like, and more specifically to a paper jam treatment technique.

2. Related Background Art

In the past, the most efficient means for a paper jamming treatment incidental to the sheet conveyance in a sheet conveying device, such as an electrophotographic copying machine and a printer, was for the subsequent sheet not to be conveyed until a sheet of copying paper had been completely ejected from the apparatus, so that the jam treatment could be completed if only the jammed sheet was removed. Such a paper conveying system is applicable to a low-speed small sized machine, but is not suitable for a high-speed large sized machine. An improved sheet conveying apparatus was therefore employed in which the interval of sheet conveyance was set as short as possible in order to speed up sheet conveyance with regard to the high-speed large sized machine. Such sheet conveying apparatus could be, for example, utilized for an image forming apparatus to obtain a high-productivity per hour.

On the other hand, due to development of multiple functions such as color copy and multiple copy, the distance of sheet conveyance was liable to be elongated with the result that the number of sheets resting on the conveyance path was increased in the above-mentioned image forming apparatus.

There has also been proposed a sheet conveying apparatus which is adapted for the automatization of collation or finishing process by connecting an output sheet processing apparatus such as a sorter or a finisher therewith as well as aforementioned development of speed-up and multi-function.

However, in the prior art described above, the entire conveying operation of the sheet conveying apparatus including output sheet processing apparatus is stopped immediately after paper jamming occurs in, for example, the output sheet processing apparatus. As a result, the sheets being conveyed remained on the conveyance path, so that an operator had to remove the remaining sheets as well as the jammed sheet in the output sheet processing apparatus by inspecting the respective portions of the conveyance path, resulting in a poor jamming treatment.

Specifically in the electrophotographic copying machine, the operator's hands were soiled with unfixed toner when removing the jammed sheet between a photosensitive body of image forming portion and a fixing device.

Furthermore, as the sheet supplying portion tended to have a further complicated and elongated path for sheet conveyance, there were more points to be inspected for remaining sheets. Accordingly the inspection and removal of the jammed paper was a time-consuming, and a lot of time was required for jam return, in other words, normalization of the apparatus.

Moreover, some sheet conveyance apparatus used in an electrophotographic copying machine, etc., functioned to automatically eject the sheets on the conveyance path from the apparatus without removing the sheets on the path one by one providing the jammed sheet was treated (referred to as autoclear function). However, the sheet which was stopped on the path in the middle of image forming obtained a defective image, thereby being discharged as a mere miss sheet. In consequence, there was a drawback that aforesaid miss sheets and normal sheets were mingled to disorder pages of the sheets.

SUMMARY OF THE INVENTION

The present invention was conceived to overcome the above problem in the prior art, and the main object thereof is to provide a sheet conveying apparatus in which the sheets being conveyed on the conveyance path are gathered at a predetermined place, enabling the removal of sheets to be easily performed and prompt jam treatment.

In order to achieve the above object, a sheet conveying apparatus according to the present invention has a jam detecting means by which the sheet conveyance is stopped in case of jam occurrence to carry out a jam treatment, an accommodating portion for jam treatment leading to aforementioned conveyance path, and a conveyance control means to accommodate the sheets being conveyed on the conveyance path into the accommodating portion for jam treatment when the jam detecting means senses a paper jamming.

The present invention with above constitution enables all the sheets on the conveyance path to be gathered in the accommodating portion for jam treatment in case of paper jamming by putting away the same into the accommodating portion.

According to the present invention, there is also provided a conveyance controlling portion which controls so as to accommodate the sheet being conveyed on the conveyance path into the accommodating portion for jam treatment, so that all the sheets can be removed in a lump with no need to remove the sheets resting on the different places of the conveyance path one by one as in the past, rendering the removal treatment (jam treatment) easier.

Moreover, the present invention was also conceived to overcome the second problem in the prior art mentioned above, and the object is to provide a sheet conveying apparatus in which the sheets being conveyed on the conveyance path are discharged into a predetermined place, thereby enabling easier removal of jammed and other enclosed sheets of copying paper and prompt jam treatment.

It is still further object of the present invention to provide a sheet conveying apparatus in which the occurrence of miss sheets can be reduced while predetermined image formation is carried out onto the sheets being conveyed.

In order to achieve the objects mentioned above, a sheet conveying apparatus has a jam detecting means for sensing a paper jamming, thereby stopping conveying the sheet on the conveyance path in case of jam occurrence, wherein there are provided a standby accommodating portion for discharge which is arranged to accommodate the sheets being conveyed on the conveyance path when paper jamming is sensed with the aid of aforementioned jam detecting means, and a discharge means which rejects the sheets being put away in the standby accommodating portion for discharge. There are also provided an image forming portion which carries out a predetermined image formation on aforesaid sheet, and an image forming controlling means which functions to perform the image formation on the sheets being put away in the standby accommodating portion for discharge. In addition, it is more effective to prohibit a further image forming which causes the disturbance of the image previously formed on the sheets.

According to the second invention having the above constitution, all the sheets resting on the conveyance path are accommodated in the standby accommodating portion for discharge to be gathered in the predetermined place, making ready to be discharged outside the apparatus after jam return. There is also provided an image forming portion to carry out the image formation onto the sheets to be put away in the standby accommodating portion for discharge, thereby preventing miss sheets from occurring. Furthermore, since image forming is prohibited during the rejection of sheets, the image previously formed on the sheets is not to be disturbed.

According to the present invention, in case of jam occurrence, the sheets being conveyed on the conveyance path are temporarily accommodated in the standby accommodating portion for discharge and then rejected outside the apparatus after jam return. As a result, the apparatus has an advantage that there is no need to remove the sheets lying scattered on the conveyance path one by one as in the past, instead the sheets to be discharged can be removed collectively, thereby rendering the removal process or jam treatment easier, preventing the paper jam from occurring again due to the carelessly remaining jammed sheet, and shortening the downtime to be required for jam return.

Because of the image forming portion which is provided to carry out the image formation onto aforesaid sheets to be accommodated, the sheet on the conveyance path can be discharged as a regular output sheet, thereby reducing the occurrence of miss sheets.

In addition, image formation is prohibited when the sheets are discharged, so that the image previously formed on the sheets is not to be disturbed, leading to the maintenance of the quality of image on the sheets.

BRIEF DESCRIPTION OF THE DRAWINGS

FIG. 1 is a block diagram of a copying machine incorporating a sheet conveying apparatus according to one embodiment of the present invention.

DESCRIPTION OF THE PREFERRED EMBODIMENTS

The present invention will hereinafter be described in detail with reference to the accompanying drawings.

Figure 3:
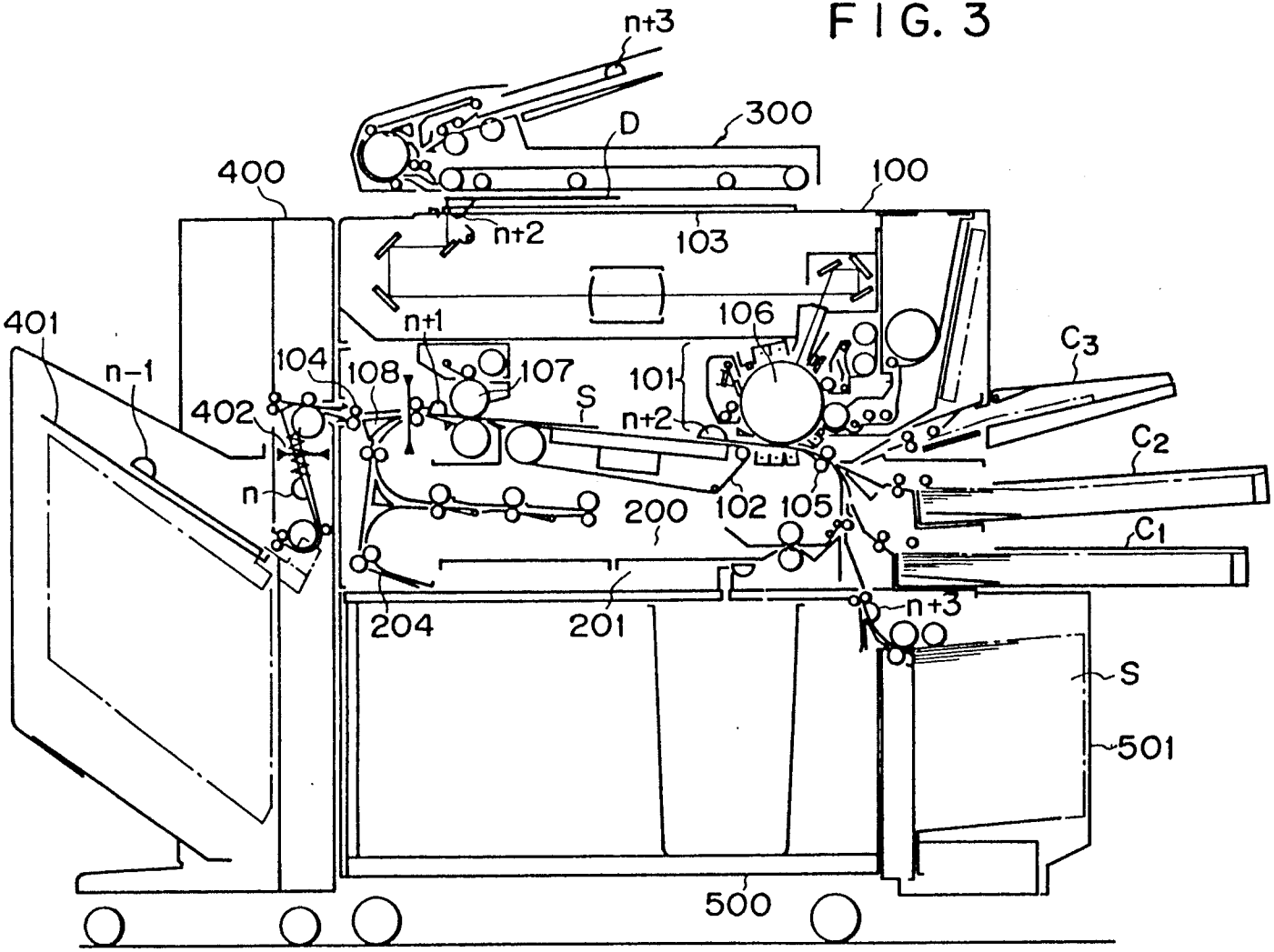
FIG. 3 is a structural cross-sectional view of a copying machine adopting a sheet conveying apparatus according to one embodiment of the present invention.

FIG. 3 is a structural cross-sectional view showing a copying machine applying a sheet conveying apparatus according to one embodiment of the present invention.

In the figure, a copying machine body 100 is equipped with an image forming portion 101, a conveying portion 102 which defines a conveying path along the image forming portion 101 to convey sheets S (recording media), and reconveying means 200 possessing a both sides processing function by which sheets S are turned over to be recorded on both sides thereof, and a multiple recording function by which the same recording face can be recorded a plurality of times. The reconveying means 200 opening into the conveying portion 102 has an intermediate tray 201 for accommodating the sheets which have passed the image forming portion 101, the intermediate tray serving as an accommodating portion for jam treatment according to the present invention. Reference numeral 300 designates a circulating document feeder (referred to as "ADF" hereinafter), numeral 400 denotes a sorting device for accommodating the sheets S which have already been recorded into a plurality of bin tray 401 (hereinafter referred to as "Sorter"), and numeral 500 represents a pedestal provided with a deck 501 for accommodating a great number of sheets S (for example, 2000 sheets). These apparatus, the ADF 300, the sorter 400, and the pedestal 500 can be optionally combined with relation to the copying machine 100. The ADF 300 is mounted on the platen glass 103 of the copying machine and the sorter 100 is connected to an output side, downstream of a discharging roller 105. Sheets S which are supplied through a deck 501, cassettes $C_1$, $C_2$, or a manual paper feed inlet $C_3$, after adjusting the conveying timing by means of a regist roller 105, are conveyed along the image forming portion 101 with the aid of the conveyance portion 102. By using a well-known electrophotographic process, a toner image developed on the photosensitive drum 106 is transferred and fixed onto the sheets S by means of a fixing device 107. A flapper 108 is provided just downstream of the fixing device 107, whereby the conveyance path is alternatively led through the conveyance portion 102 either to the sorter 400 following the discharging roller 104 or to the intermediate tray 201 of the re-conveyance means 200. Now during image forming in continuous copying operation, suppose that n-th sheet (shown by n in the figure) is jammed in the sorter 400. At this time, e.g., in the bin tray 401 already output sheets from 1st to (n−1)th are accommodated, (n+1)th sheet resting at the fixing device 107 disposed in the upsteam of discharging roller 104, (n+2)th sheet being in contact with the photosensitive drum 106, and (n+3)th sheet being located in the position just after the deck 501. A document corresponding to the (n+2)th sheet is mounted on the platen glass 103, which is about to be replaced by the document corresponding to the (n+3)th sheet. Paper jamming in the sorter 400 is detected by means of photosensor 402 serving as a jam detecting means.

Figure 4:
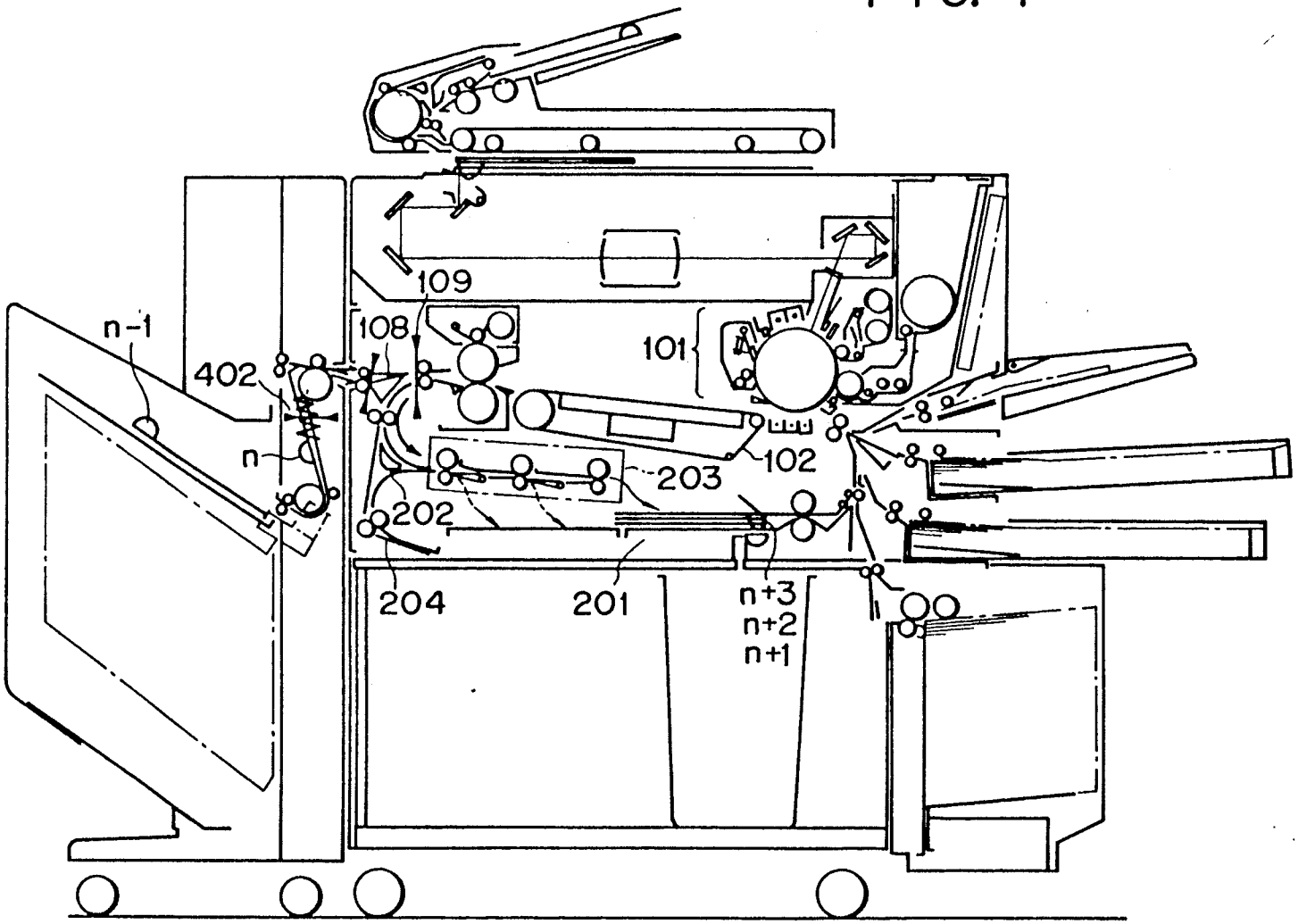
FIG. 4 is a structural cross-sectional view showing the movement of the copying machine illustrated in FIG. 3 in case of jam occurrence.

In the prior art, a sorter jamming due to the n-th sheet stopped all conveyance of the copying machine 100, while in the present invention sheets do not remain on the conveyance path as shown in FIG. 4. Adjacent to the 108 there is provided a sensor 109 by which the presence or absence of sheet can be detected. Providing that sheets preventing the movement of the flapper 108 are not present, and therefore sheets on the conveyance path can be accommodated into the intermediate tray 201, the flapper 108 is operated so as to lead the conveying portion 102 into the intermediate tray 201, thereby accommodating the sheets on and after (n+1)th into the intermediate tray. On the way to the intermediate tray 201, another flapper 202 is provided on the conveyance path which acts to selectively change over reverse or non-reverse mode for sheets corresponding to whether the image is formed on the opposite side or superimposed on the same side.

In non-reverse mode, the sheets are directly guided to a discharge gate 203 and stacked up, with the image formed surface downward, through the discharge gate 203 corresponding to the sheet size. In reverse mode, the sheets are temporarily led to a reverse path (switch-back path) 204, guided to the discharge gate 203 with the trailing edge thereof ahead, and is accommodated to stack up with the image formed surface upward. In case of jam occurrence, the conveying operation in the copying machine 100 is not interrupted, so that (n+3)th sheet in the position just after feeding as shown in FIG. 3 could be conveyed into the accommodating portion, and accommodated in the intermediate tray 201 before long.

FIG. 1 shows the block diagram of the copying machine adopting the sheet conveying apparatus according to one embodiment of the present invention, wherein the identical structures thereof to those shown in FIGS. 3 and 4 are marked with identical signs to those in this figure. In FIG. 1, reference numeral 1 designates a controlling portion which controls entire operation of the copying machine. In case paper jamming takes place in the sorter 400 and the jam signal is inputted with the aid of the photosensor 402, the controlling portion 1 controls the flapper 202, discharge gate 203 or the like in such a way that the sheets being conveyed and adapted to be accommodated into the intermediate tray 201 are caused to be accommodated therein after making sure that there are no sheets to prevent the movement of the flapper 108. The control portion 1 also controls the movement of several portions in accordance with the respective key commands of the operating portion 2 and permits the displaying portion 3 to indicate a message and the like according to the operating condition.

Figure 2:
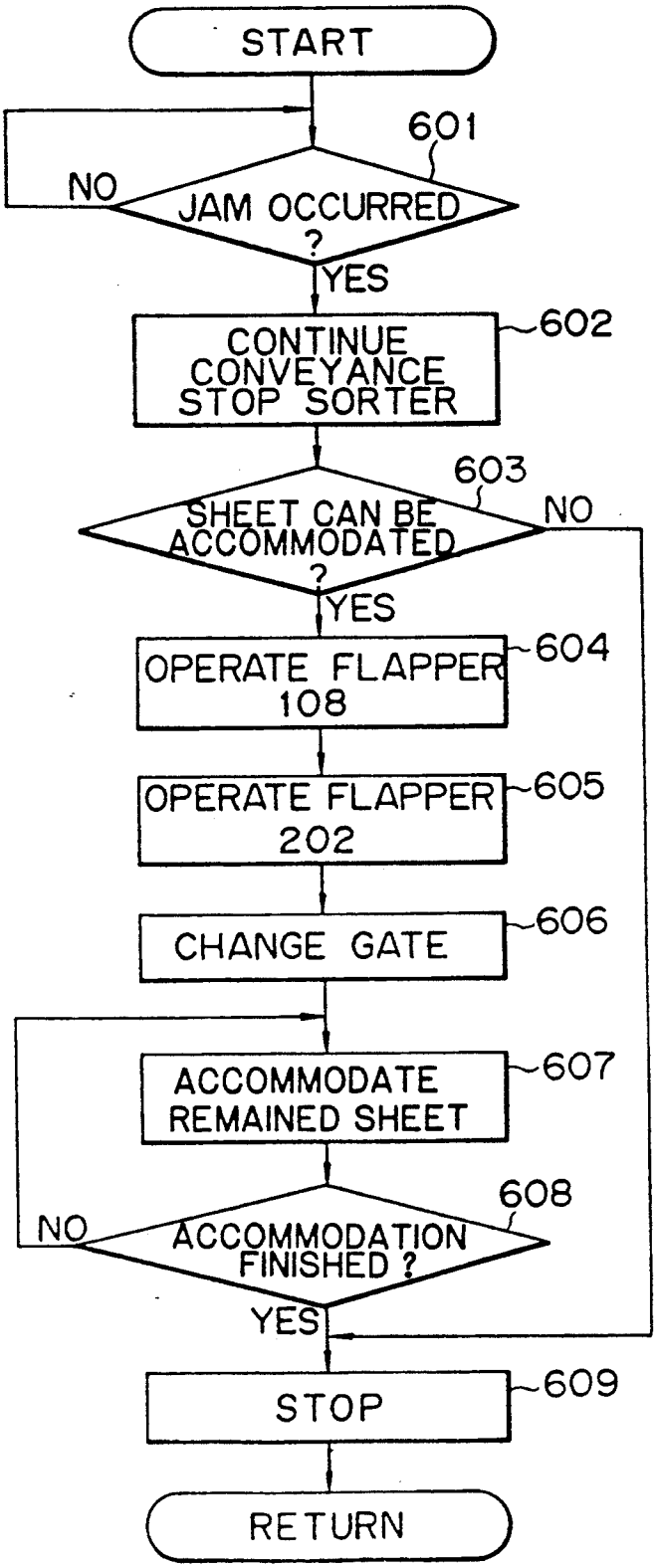
FIG. 2 is a flow chart showing a jam treatment controlling procedure according to the present invention.

A control procedure for jam treatment in the control portion 1 illustrated in FIG. 1 will now be described in accordance with the flow chart shown in FIG. 2.

In the first place, the controlling portion 1 stands by for paper jamming which occurs in the sorter 400 etc. (Step 601), and stops immediately the operation of the sorter 400 while continuing the conveying operation in the machine (Step 602).

In the second place, the controlling portion 1 detects the sheets which make the flapper 108 inoperative with the aid of the sensor 109 (Step 603), actuates the flapper 108 so as to accommodate the sheets being conveyed into the intermediate tray 201 when there are no sheets to be found (Step 604), actuates the flapper 202 according to the reverse/non-reverse mode of the sheets (Step 605), and leads the sheets on the conveyance path to the discharge gate 203. The discharge gate 203 is changed over in accordance with the sheet size (Step 606), and the sheets are accommodated in the intermediate tray 201 (Step 607).

Afterward, the controlling portion 1 confirms whether the sheets are present or not on the conveyance path by the signal of well-known jam detecting device (not shown in the figure) disposed at several points of the conveyance path, judges whether all the sheets on the conveyance path have been accommodated into the intermediate tray 201 (Step 608) and stops the conveying operation of the copying machine 100 when judged "YES" (Step 609) to complete the process.

On the other hand, when judged "NO" at Step 6, it instructs to jump to Step 609 therefrom, whereby the conveying operation of the copying machine 100 is stopped at once to complete the process. Moreover, the displaying portion 3 indicates appropriate display when paper jamming takes place.

As described above, the sheets on the conveying path can be gathered into the intermediate tray 201 by incorporating the sheet conveying apparatus according to the present invention, for example, into a copying machine, so that all the sheet can be removed at one time, thereby eliminating the troublesome process of removing the sheet lying scattered at several places on the conveyance path one by one with close inspection. Furthermore, the use of existing intermediate tray 201 leads to space and cost efficiency compared to that of newly manufactured accommodating tray and assures the reliability of the copying machine. As well as soiling of operator's hands with the unfixed toner in the vicinity of the fixing apparatus, re-occurrence of paper jamming due to carelessly remaining jammed sheet can be prevented, and down-time required for jam return is to be shortened.

When the sheets are accommodated into the intermediate tray 201, they may be carried in either mode of reverse or non-reverse, and regardless of the method thereof.

In the above embodiment, the sorter jam is typically shown, but the present invention is also effective against paper jamming at the discharge portion of the apparatus body (discharge roller 104) or ADF 300. In this case, it is necessary that the conveyance path leading to the intermediate tray 201 is maintained operative, while stopping only the operation of the discharge portion or ADF 300 being subjected to paper jamming.

In the above description, the sensor 108 is disposed just before the flapper 108 to judge whether to accommodate the sheets into the intermediate tray 201 or not. However the sensor 109 is not necessarily indispensable means, instead a sensor (existing one available) located at the upstream of the flapper 108 and a standard pulse generating means may be used in combination, whereby the position of the sheets on the conveyance path could be detected to make the above judgement.

In the above embodiment, a sheet conveying apparatus is applied to an electrophotographic copying machine based on optical information, otherwise this invention is applicable to a printer based on electronic information, a printing press, an ADF serving as a sheet conveying apparatus, or the like. In addition, the accommodating portion for jam treatment may be provided at several places as long as jam treatment is facilitated thereby.

Next the second embodiment of the present invention will be described in detail with reference to the accompanying drawings, FIGS. 5 to 9. In this embodiment, the sheets being put away in the standby accommodating portion for discharge are to be ejected outside the apparatus after jam treatment. Accordingly, the description of the same operations as those in the first embodiment will be omitted, and the procedure after jam treatment will be described in detail.

Figure 9:
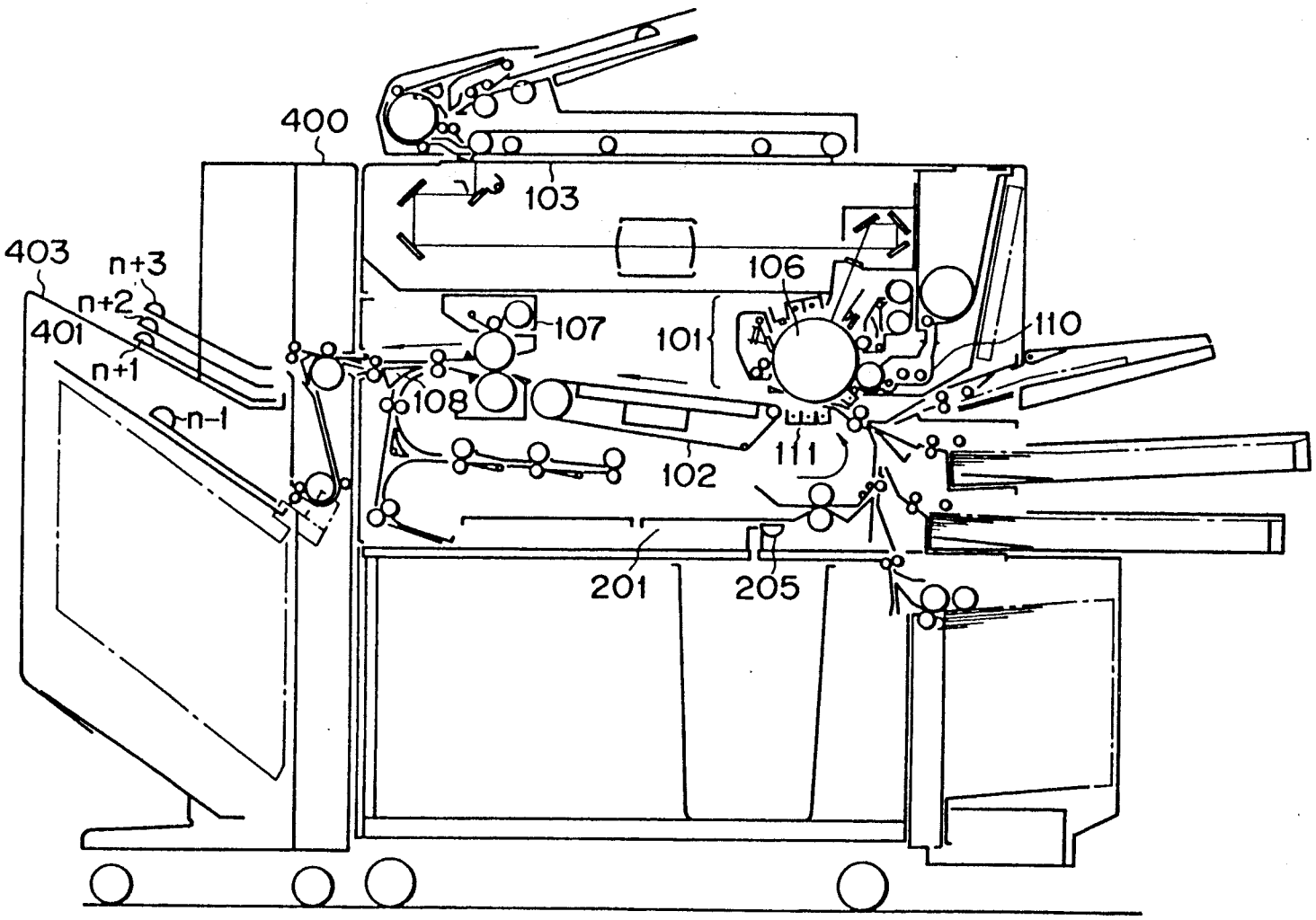
FIG. 9 is a structural cross-sectional view showing the movement of sheet discharge after jam return of the copying machine illustrated in FIG. 7.

When the jammed sheet n is taken off and proper jam treatment is conducted, the sheets being accommodated in the intermediate tray 201 are discharged outside the apparatus as shown in FIG. 9. The sheets are again fed from the intermediate tray 201 into the conveying portion 102 by means of the paper feed roller 205. In order to know the completion of re-feed, one may previously count the number of sheets being accommodated in the intermediate tray by means of a memory, etc., or may provide a sensor in the intermediate tray 201, thereby detecting the running out of re-feed sheets. The conveying portion 102 opens into the sorter 400 through the flapper 108 and the sheets are discharged onto the other tray 403 than the bin tray 401 on which the sheets were ejected before as shown in the figures. The sheets may be discharged on the bin tray 401 where the sheets have already piled up.

Figure 8:
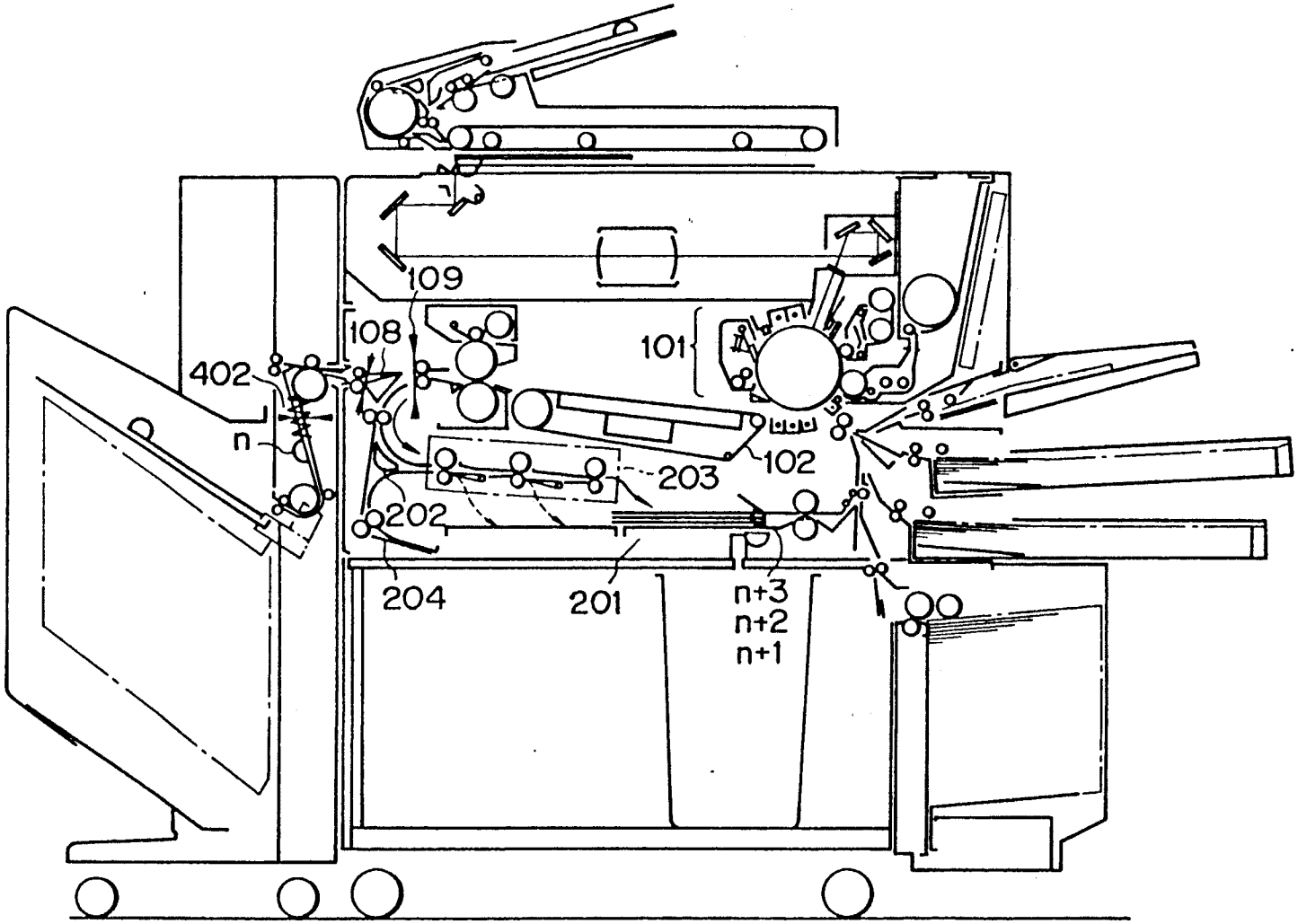
FIG. 8 is a structural cross-sectional view showing the movement of the sheet accommodation in case of jam occurrence of the copying machine illustrated in FIG. 7.

Furthermore, when the sheets on the conveyance path are accommodated into the intermediate tray due to jamming in the sorter as shown in FIG. 8, image forming can be normally carried out onto the sheets. In other words, the sheets are to be accommodated into the intermediate tray after image forming thereon as usual. In this case, when the sheets are subsequently discharged, it is desirable that white image (no image) be overlaid to be multiple images in order not to disturb the image which has already been formed on the sheet. In order to procure a similar effect, image forming operation at the image forming portion 101 may be made inoperative, more specifically, a blank exposure may be entirely applied onto the photosensitive drum 106 in such a way that latent image is not to be formed regardless of the document to be mounted on the platen glass 103. It may be otherwise conceived that the developing device 110 is not made to be actuated, or that the toner image is not made to be transferred onto the sheet by breaking the corona of a transfer electrifying device 111. With above constitution, the sheet on the conveyance path which was disposed of as a miss sheet in the past, can be used as a regular output sheet.

Figure 5:
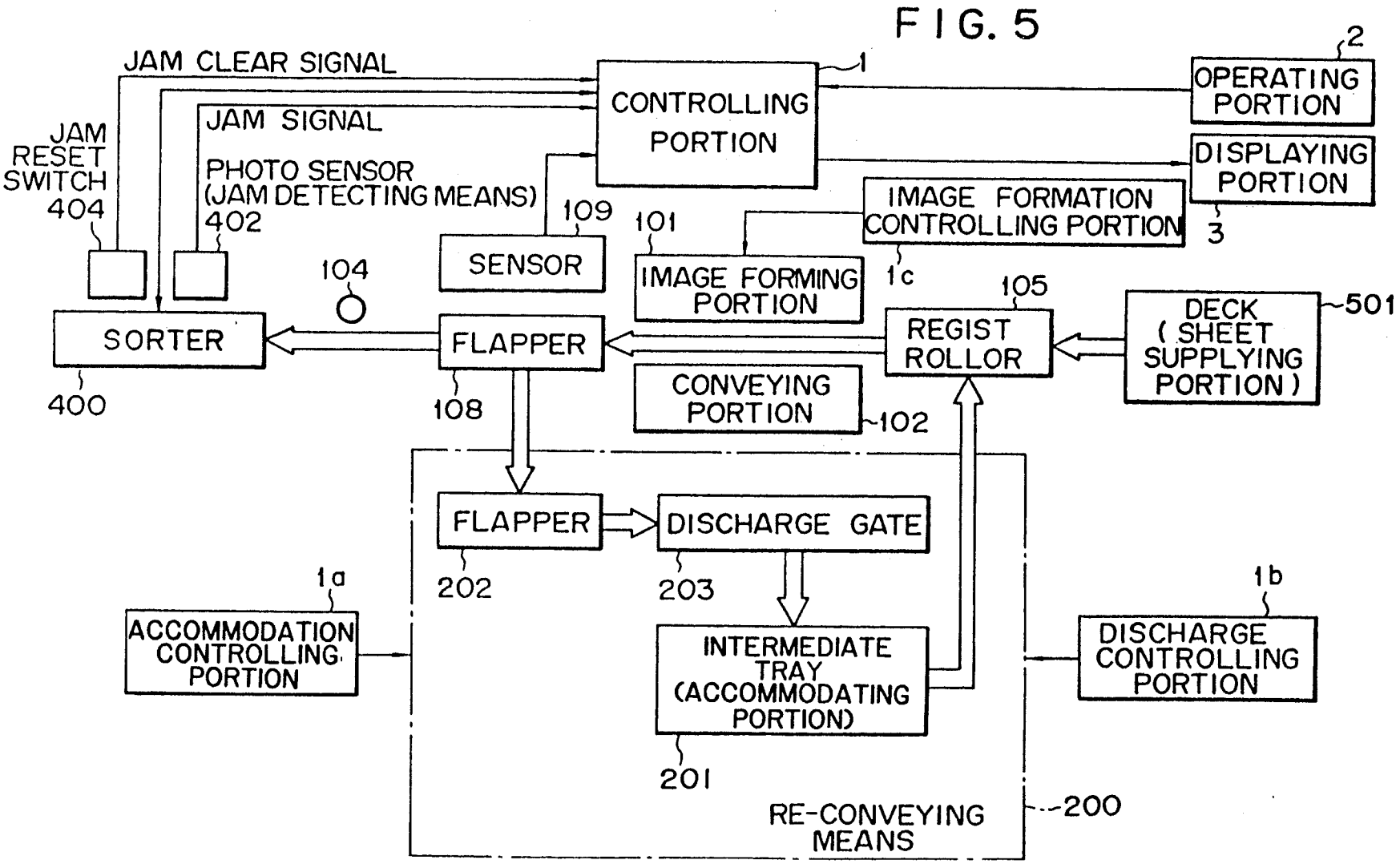
FIG. 5 is a block diagram of a copying machine applying a sheet conveying apparatus according to the second embodiment of the present invention.
Figure 7:
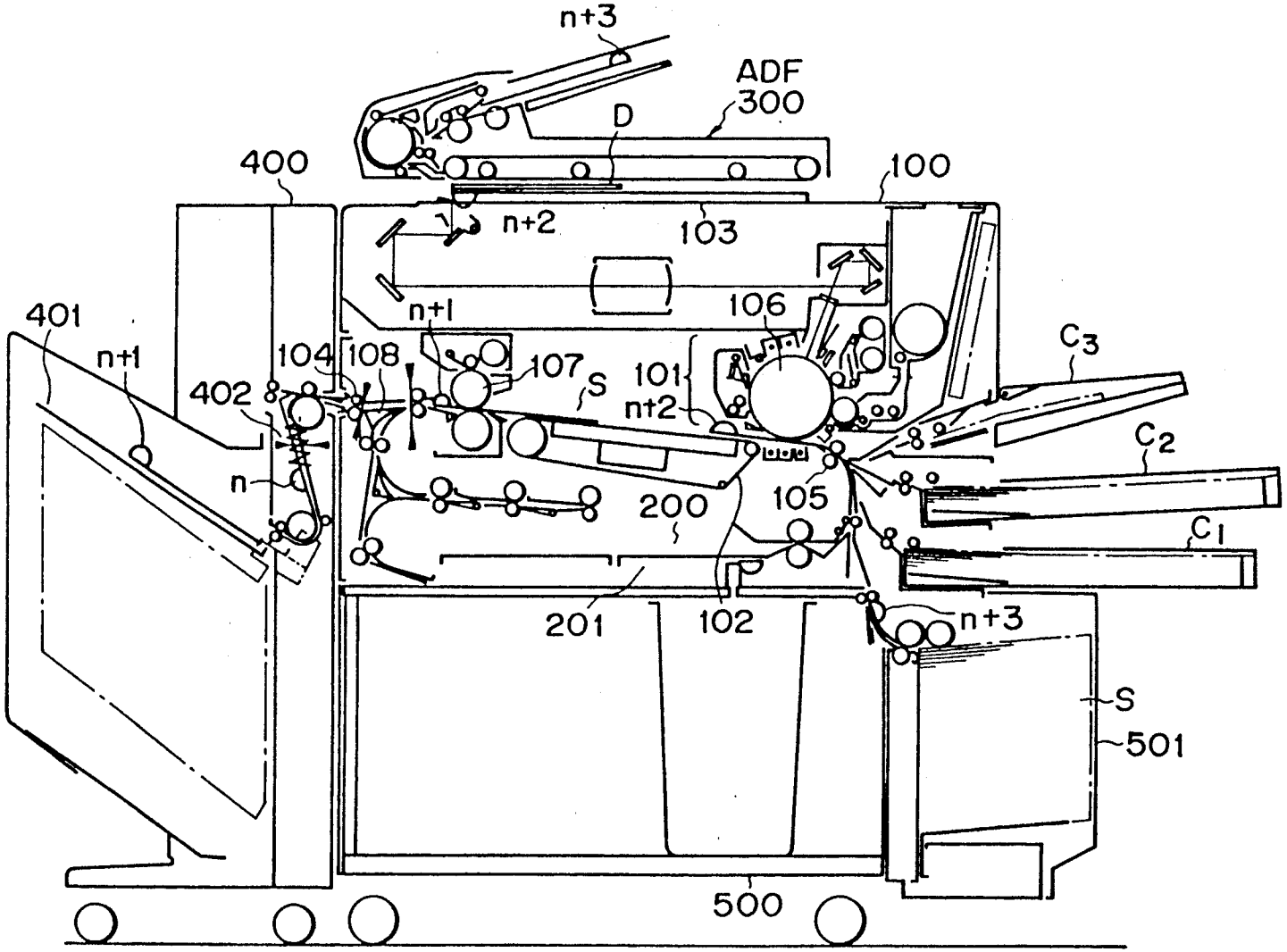
FIG. 7 is a structural cross-sectional view of the copying machine incorporating a sheet conveying apparatus according to the second embodiment of the present invention.

FIG. 5 designates a block diagram of the copying machine illustrated in FIGS. 7–9 applying a sheet conveying apparatus according to the second embodiment of the present invention. In the figure, the same numerals or signs denote identical members to those in FIGS. 1–4 and FIGS. 7–9.

Reference numeral 1 represents a controlling portion which controls the entire operation of the copying machine, and which has an accommodation controlling means 1*a*, a discharge controlling means 1*b*, an image forming controlling means 1*c* and the like. The accommodation controlling portion 1*a* allows the sheets being conveyed on the conveyance path to be accommodated into the intermediate tray, when for example, the photosensor 402 detects a paper jamming. After completing jam treatment, the discharge controlling portion 16 causes the re-conveying means 200 to re-supply the sheets being accommodated in the intermediate tray 201 into the conveying portion 102, and then causes the sorter 400 to discharge the sheets outside the apparatus, according to the jam clear signal which is input by pressing a jam reset switch 404. The image forming controlling portion 1*c* allows the image forming portion 101 to form a predetermined image onto the sheets, carries out the image forming onto the sheets which are accommodated in the standby accommodation portion for discharge, and prohibits newly image forming which disturbs the image which has been already formed on the sheets in case of sheet discharge. The controlling portion 1 controls the operations of several portions in accordance with the respective key commands of the operating portion 2, and allows the displaying portion 3 to show the message, etc., according to the state of operation.

Figure 6:
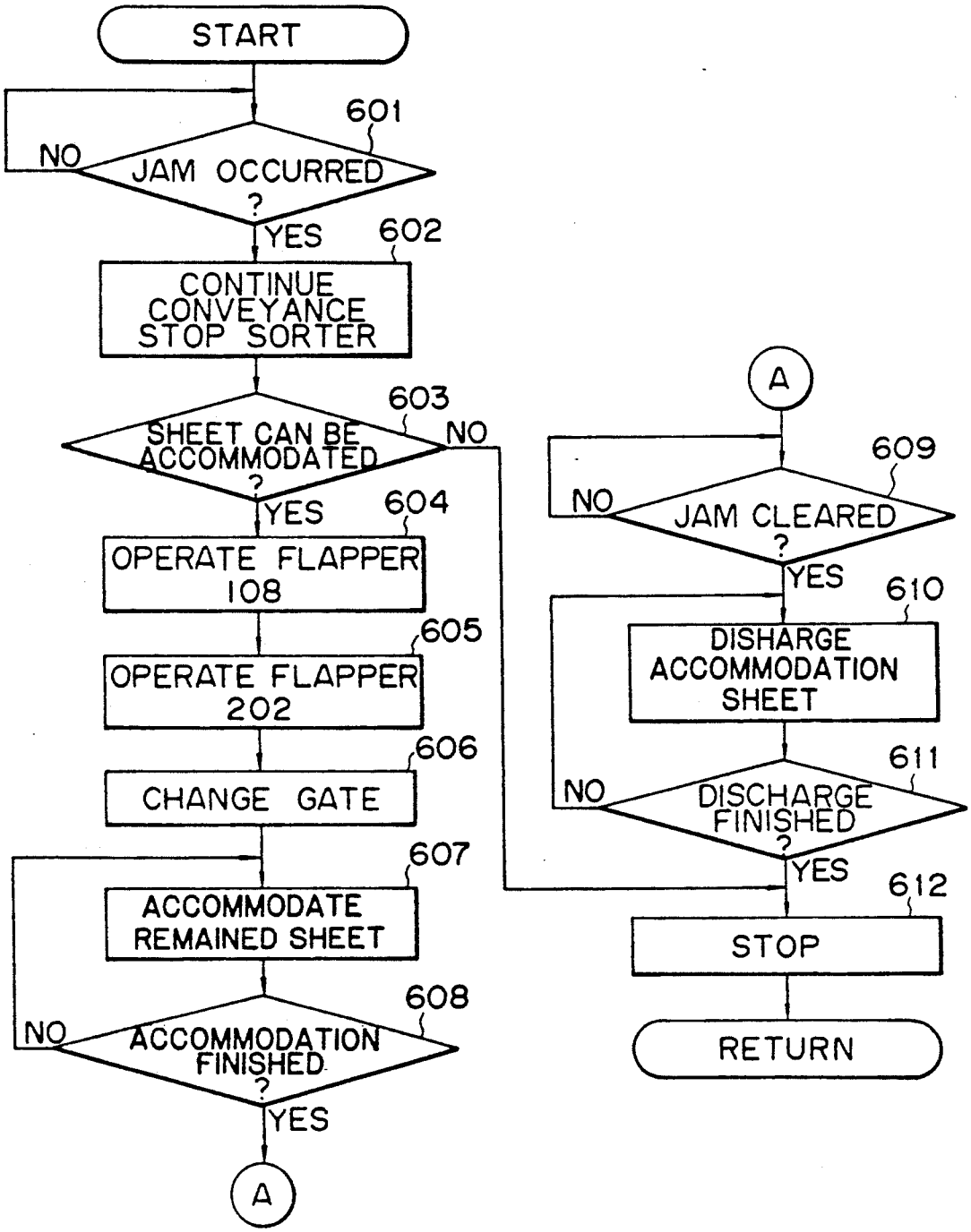
FIG. 6 is a flow chart showing a jam treatment controlling procedure according to the second embodiment of the present invention.

A jam treatment controlling procedure in the controlling portion illustrated in FIG. 5 will be hereinafter described in accordance with FIG. 6.

In the first place, the controlling portion 1 stands by for a paper jamming which takes place in the sorter 400 etc. (Step 601), and stops the operation of the sorter 400 immediately while proceeding with the conveyance in the machine and the image forming in case of a sorter jam (Step 602).

In the second place, the accommodation controlling portion 1*a* detects, if any, the sheets which will bring about an inoperativeness of the flapper 108 by means of the sensor 109 (Step 603), actuates the flapper 108 to accommodate the sheets being conveyed into the intermediate tray 201 when there is no sheets to be found (Step 604), actuates the flapper 202 according to the reverse/non-reverse mode for the sheets (Step 605), and guides the sheets on the conveyance path to the discharge gate 203. The discharge gate 203 is changed over according to the sheet size (Step 606), and allows the intermediate tray 201 to accommodate the sheets (Step 607).

In the following steps, the accommodation controlling portion la confirms the presence or absence of the sheets on the conveyance path with the aid of the signal of such as jam detecting device (not shown) which was disposed at several places on the conveyance path in the prior art, judges whether all the sheets on the conveyance path have been accommodated into the intermediate tray 201 (Step 608), and stands by for jam return when judged "YES" (Step 609).

Afterward, when jam is cleared and jam cleared signal is input, the discharge controlling portion 16 initiates discharge of the accommodated sheets (Step 610), judges whether all the accommodated sheets have been discharged (Step 611), and stops the conveying operation of the copying machine 100 when judged "YES" (Step 612), to complete the process. In the course of above steps 610 - 612, there is prohibited an image formation onto the sheets.

On the other hand, when judged "NO" at Step 603, the process jumps to Step 612 where the conveying operation of the copying machine 100 and the image formation are stopped at once to complete the process. Upon occurring of jam, the displaying portion 3 indicates a proper display.

As described above, the sheets which have been temporarily accommodated into the intermediate tray 201 is discharged into one bin tray of the sorter 400, so that it is unnecessary to remove the sheets lying scattered on the conveyance path one by one with careful inspection.

By incorporating the sheet conveying apparatus into an image forming apparatus such as a copying machine, a regular image can be formed onto the sheets to be disposed of, thereby reducing the number of miss sheets. Furthermore an existing intermediate tray is utilized so that space and cost efficiency can be procured compared to a newly provided accommodation tray, resulting in maintaining reliance of the copying machine.

What is claimed is:

1. A image forming apparatus having an image forming portion, a re-cycle path for reintroducing a sheet on which an image is formed at said image forming portion to said image forming portion, an intermediate tray disposed in said re-cycle path for receiving the sheet therein, re-feed means for separating the sheets in said intermediate tray one by one to re-feed said sheets to said image forming portion, discharge path for discharging the sheet on which the image is formed to a sheet accommodating portion and flapper means for selecting and directing a sheet to one of said re-cycle path and said discharge path, comprising:

first detection means for detecting a sheet jam in said discharge path; and control means for controlling said flapper means and said re-feed means, wherein when the sheet jam is detected by said first detection means said control means switches said flapper means to a re-cycle side to introduce the sheet located upstream of said flapper means to said intermediate tray, then activates said re-feed means after removal of a jammed sheet is finished to feed the sheet from said intermediate tray to said discharge path and switches said flapper means to a discharge side to discharge the sheet through said discharge path.

2. An image forming apparatus according to claim 1, further comprising an image formation controlling means for carrying out the image forming on the sheets to be accommodated into said intermediate tray.

3. An image forming apparatus according to claim 2, wherein said image formation controlling means prohibits formation of a new image on the sheet upon discharging the sheets from said intermediate tray.

4. An image forming apparatus according to claim 3, further comprising a means for rendering whole surface blank exposure to a photosensitive member as said means for inhibiting image formation.

5. An image forming apparatus according to claim 1, further comprising a sorter, and wherein after completion of the jam treatment the discharged sheets are introduced into bins different from bins for sorting.

6. An image forming apparatus according to claim 1, further comprising second detection means for detecting when all the sheets located upstream of said flapper means are introduced into said intermediate tray and interrupting the sheet feeding in said image forming apparatus.

7. An image forming apparatus according to claim 1, further comprising second control means for turning off the sheet feeding in said image forming apparatus after all sheets located upstream of said image forming portion are completely imaged and introduced to said intermediate tray.

8. An image forming apparatus according to claim 1, further comprising a sorter for sorting discharged sheets, said first detection means detecting a sheet jam in said sorter.

9. An image forming apparatus according to claim 8, further comprising second control means for turning off said sorter after the jam detection, and for turning off the sheet feeding in said image forming apparatus after all of the sheets located upstream of said flapper means are introduced into said intermediate tray.

10. An image forming apparatus according to claim 1, further comprising original automatic feeding apparatus, and third control means for introducing the remaining sheet to said intermediate tray even upon detection of the original jam.

11. An image forming apparatus having an image forming portion, a re-cycle path for reintroducing a sheet on which an image is formed at said image forming portion to said image forming portion, an intermediate tray disposed in said re-cycle path for receiving the sheet therein, re-feed means for separating the sheets in said intermediate tray one by one to re-feed said sheets to said image forming portion, discharge path for discharging the sheet on which the image is formed at said image forming portion to a sheet accommodating portion, and flapper means for selecting and directing the sheet to one of said re-cycle path and said discharge path, comprising:

first detection means for detecting a sheet jam in said discharge path; and control means for switching said flapper means, when the sheet jam is detected by said first detection means, to a re-cycle side to introduce the sheet located upstream of said flapper means to said intermediate tray, and to interrupt the sheet feeding in said image forming apparatus after the sheets are introduced into said intermediate tray and before said sheet jam in said discharge path has been cleared.

12. An image forming apparatus having an image forming portion, a provisional path with an intermediate tray for provisionally receiving a sheet on which an image if formed at said image forming portion, re-feed means for separating the sheets in said intermediate tray for discharging, discharge path for discharging the sheet on which the image is formed at said image forming portion, and flapper means for selecting and directing a sheet to one of said provisional path and said discharge path, comprising:

first detection means for detecting a sheet jam in said discharge path; and control means for controlling said flapper means and said re-feed means, wherein when the sheet jam is detected by said first detection means said control means switches said flapper means to said provisional path to introduce the sheet located upstream of said flapper means to said intermediate tray, the activates said re-feed means after removal of the jammed sheet is finished to feed the sheet from said intermediate tray to said discharge path, and switches said flapper means to a discharge side to discharge the sheet through said discharge path.

* * * * *

UNITED STATES PATENT AND TRADEMARK OFFICE

CERTIFICATE OF CORRECTION

PATENT NO. : 5,322,274
DATED : June 21, 1994
INVENTOR(S) : YUJI TAKAHASHI, ET AL.

It is certified that error appears in the above-indentified patent and that said Letters Patent is hereby corrected as shown below:

Column 5,
line 40, "this figure." should read --these figures.--.

Column 9,
line 13, "A" should read --An--.

Column 10,
line 59, "the" should read --then--.

Signed and Sealed this

Eighth Day of November, 1994

Bruce Lehman

*Attest:*

BRUCE LEHMAN

*Attesting Officer*

*Commissioner of Patents and Trademarks*